United States Patent [19]

Tsai

[11] 4,045,625

[45] Aug. 30, 1977

[54] DISTRIBUTOR

[76] Inventor: Chin-Chin Tsai, 10, Lane 62, Te Kuang Street, Tainan, Taiwan, China /Taiwan

[21] Appl. No.: 718,546

[22] Filed: Aug. 30, 1976

[51] Int. Cl.[2] ..... H01H 19/00; F02P 7/00

[52] U.S. Cl. ..... 200/24; 123/146.5 R; 123/146.5 A; 200/19 R; 200/19 A

[58] Field of Search ..... 200/19 R, 19 A, 20, 200/22, 24, 25, 26, 28, 8 R, DIG. 7; 123/146.5 A, 146.5 R

[56] References Cited

U.S. PATENT DOCUMENTS

| | | | |
|---|---|---|---|
| 2,510,067 | 6/1950 | Callander | 200/28 X |
| 2,730,582 | 1/1956 | Jernigan | 200/22 |
| 2,839,622 | 6/1958 | Billings | 200/20 |
| 3,022,389 | 2/1962 | Wolrab | 200/24 |
| 3,087,000 | 4/1963 | Krone | 200/24 |
| 3,345,472 | 10/1967 | Kuhlman et al. | 200/26 |
| 3,647,995 | 3/1972 | Wisely | 200/24 |

*Primary Examiner*—James R. Scott

*Attorney, Agent, or Firm*—Shoemaker and Mattare, Ltd.

[57] ABSTRACT

A distributor for internal combustion engines, and more particularly a distributor employing a distributing wheel and a set of two carbon brushes in place of the conventional circuit breaker and circuit breaker arm to insure accurate timing, minimum wear to parts, and no missing of spark plugs to be fired thereby.

3 Claims, 8 Drawing Figures

DISTRIBUTOR

BACKGROUND OF THE INVENTION

Distributors presently in common use throughout the world all employ a contact breaker arm which by force of a spring presses in close contact with a contact breaker. When the contact breaker is pressed closed, an electrical circuit will be completed. Distributors employing such elements have five major commonly recognized defects:

1. If the timing of the closing of the contacts of the circuit breaker is too slow, the spark plugs will fire late. If the contacts are closed for too long a period, although the magnetic field will be completely established, the firing will not be complete. Therefore, the firing of the spark plugs in the engine will not be able to maintain a stable, steady firing operation.

2. If the timing is too fast, the spark plugs will fire prematurely. As the contacts will be closed for too short a time, the electric current passing the ignition coil of the primary coil will be insufficient to establish a complete magnetic field. Therefore, the spark plugs will tend not to fire, or miss, during high speed operation.

3. If the spring of the breaker arm is too strong, it will damage the contact breaker.

4. If the spring is too loose or weak, there will be oscillation between the contacts, causing the spark plugs to miss during high speed operation.

5. In addition, it is very difficult to adjust the angle of the contact breaker to insure proper timing and proper breaking of contacts, and it is often because of the difficulty of adjustment and timing that the contacts are damaged by sparks upon breaking of the contact.

SUMMARY OF THE INVENTION

The purpose of the present invention is to improve the above mentioned defects in the art and to eliminate the need for conventional contact breaker arms and contact breakers as presently employed in breaker point contact type distributors and to replace these parts with a novel distributing wheel which will enable a high voltage current to cause each spark plug to fire at the appropriate time, providing for a smooth running engine.

Another purpose of the present invention is to provide a distributor wherein there is excellent contact between a metal conducting ring and carbon brush.

It is a further purpose of the present invention to provide a distributor whereby due to accurate timing an engine will run continuously and smoothly whether at very high or very low speeds.

It is yet a further purpose of this invention to provide a distributor that will enable an engine to make the best use of all of the fuel supplied thereto due to its smooth operation, resulting in better mileage and less pollution of the air.

DETAILED DESCRIPTION OF THE INVENTION

Figure 1:
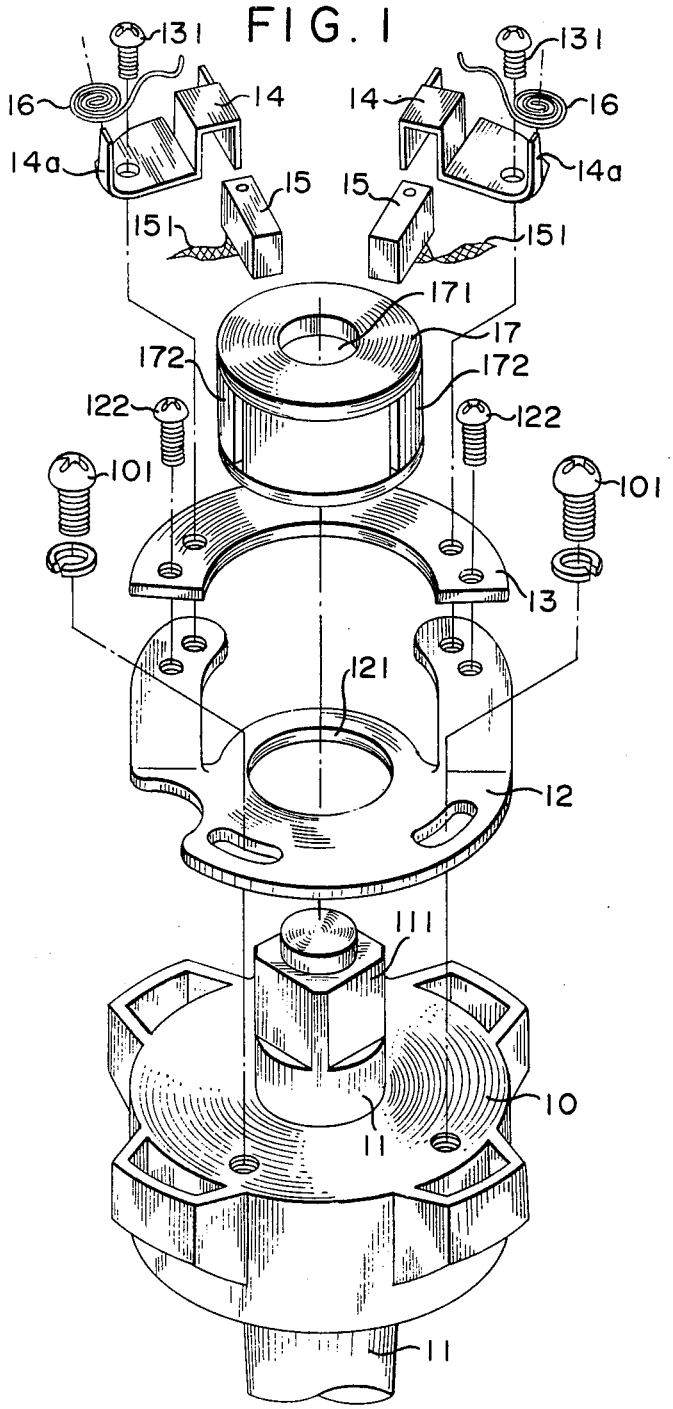
FIG. 1 is an exploded view of a preferred embodiment of a distributor according to the present invention.

As shown in FIG. 1, the present invention relates to a distributor having a base 10 provided on a rotating central shaft 11, a base plate secured to said base by means of screws 101 with the shaft 11 extending through a hole 121 provided for that purpose through the central portion thereof, a semicircular insulation plate 13 secured to said base plate 12 by means of screws 122, and two carbon brushes 15—15 secured the insulation plate 13 by means of carbon brush carriages 14—14 which are secured to the insulation plate 13 by means of screws 131—131. Each carriage 14 is provided with a post **14*a* over which is set a tension spring 16 for the purpose of maintaining good contact between the respective carbon brush and a distributing wheel 17 which is keyed on a squared collar 111 of the central shaft 11 which is squared to insure rotation of said distributing wheel 17 upon rotation of said shaft 11**.

Figure 2A:
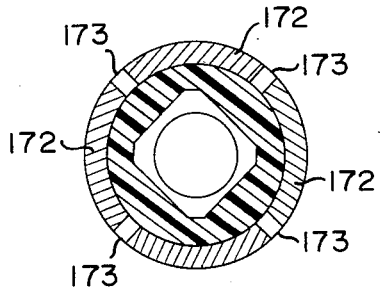
FIG. 2A is a view of the distributing wheel thereof in horizontal cross-section.
Figure 2B:
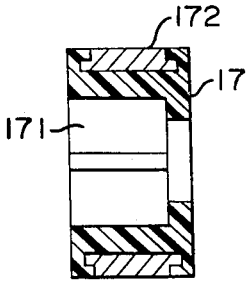
FIG. 2B is a similar view in longitudinal cross-section.
Figure 3A:
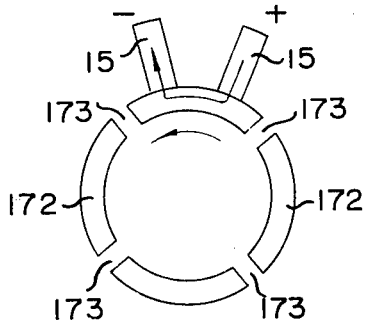
FIG. 3A shows a current running between two carbon brush poles of the distributing wheel according to one embodiment of the present invention.
Figure 3B:
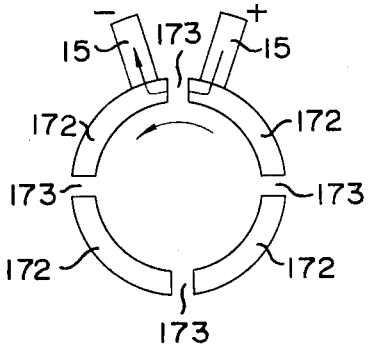
FIG. 3B is a similar view wherein the current has been broken.

As shown in FIGS. 2A and 2B, the sides of the distributing wheel 17, which is made of plastic or a similar non-conductive material, are provided with a plurality of metalic conducting plates 172, one for each cylinder of the engine to be used, which are securely imbedded in the sides thereof with an open space or gap 173 being left between each two adjacent plates 172. The interior 171 of the wheel 17 is squared to correspond to and fit tightly on the squared collar 111 of the shaft 11. As one carbon brush 15 is connected to a negative terminal and the other to a positive terminal by means of cables 151—151 (see FIG. 1) and as both carbon brushes 15 are maintained in close contact with the conductive plates 172 of the distributing wheel 17, a current will be passed to a spark plug as long as both carbon brushes are in contact with the same conduction plate 172 (see FIG. 3A). As soon as one of the gaps 173 comes between the carbon brushes, the current will be broken (see FIG. 3B) until the next conduction plate comes into contact with both of the carbon brushes to provide a current to cause the next spark plug in sequence to fire. By controlling the length of the conduction plates and the gaps therebetween is possible to insure that the distributing wheel 17 will close or break a circuit with precise and steady timing as specified parts of the distributing wheel 17 come into contact with the carbon brushes 15, as the distributing wheel 17 revolves at a stable speed in proportion to the speed at which the engine is operating.

Figure 4A:
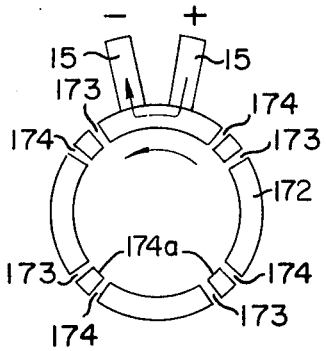
FIGS. 4A, 4B and 4C are similar views showing another embodiment of the present invention.
Figure 4B:
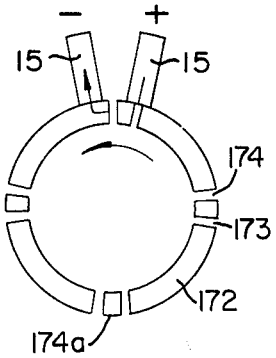
Figure 4C:
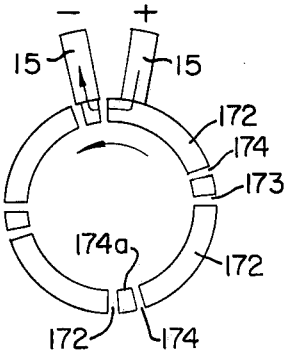

Should it be desirable to increase the interval of no current, for example if the length of the gap desired approaches, equals, or exceeds the width of the end of the carbon brush in contact with the distributing wheel, the gap may be divided into two gaps 173 and 174 with an intermediate strip or piece of metal **174*a* as shown in FIGS. 4A–4C**.

In this way it is possible to insure accurate timing of the firing of the spark plugs in order at any speed and to eliminate missing. In addition, there is no circuit breaker or spring biased circuit breaker arm involved, cutting the chances of malfunction and wear to a minimum. Due to the accurate timing at both high and low speeds, much fuel will be saved and exhaust will be cleaner than when using conventional distributors. When worn, the carbon brushes may be replaced quickly and inexpensively.

I claim:

1. A rotary type distributor comprised of a central rotary shaft extending through a base means having a square collar provided on that extending end, a base plate disposed around said extending shaft end on said base means, a semicircular insulating ring disposed on said base plate, a rotary wheel of a non-conductive material keyed on the square collar of said rotary shaft and able to rotate in response to rotation of said shaft, said rotary wheel having a plurality of metal plates of equal length imbedded in the sides thereof in such a way that there is a gap provided between each two adjacent plates, two carriages having inverted U shaped portions, each carriage being disposed on said insulating ring and having an upwardly extending post on which is mounted a spring, two carbon brushes, each one of said brushes disposed in the inverted U shaped portion of one of said carriages and biased by said spring towards and in contact with the metal plates of the distributing wheel, the distance between the centers of the brush ends contacting said plates being less than the length of one of the plates, and the other ends of said brushes thereof not contacting the plates being connected by cables to positive and negative pole of an electrical source respectively, so that upon rotation of the wheel both carbon brushes come into contact with a single metal plate, setting up an electrical current, and upon further rotation of the wheel one of the gaps between the plates comes between the carbon brushes, causing the current to cease.

2. A rotary type distributor as in claim 1, wherein said distributing wheel is provided with one metal plate for each cylinder of an engine to which the distributor is intended to supply voltage.

3. A rotary type distributor as in claim 2, wherein said gaps include an intermediate metallic strip provided therein to prevent damage to the ends of the carbon brushes.

* * * * *